US008656853B2

(12) United States Patent
Kohnen et al.

(10) Patent No.: US 8,656,853 B2
(45) Date of Patent: Feb. 25, 2014

(54) SEALABLE DOME ASSEMBLY

(75) Inventors: William Kohnen, Claremont, CA (US); Ian Sheard, Claremont, CA (US)

(73) Assignee: SEAmagine Hydrospace Corporation, Claremont, CA (US)

( * ) Notice: Subject to any disclaimer, the term of this patent is extended or adjusted under 35 U.S.C. 154(b) by 162 days.

(21) Appl. No.: 13/246,716

(22) Filed: Sep. 27, 2011

(65) Prior Publication Data

US 2012/0073490 A1 Mar. 29, 2012

Related U.S. Application Data

(60) Provisional application No. 61/386,906, filed on Sep. 27, 2010.

(51) Int. Cl.
*B63G 8/00* (2006.01)

(52) U.S. Cl.
USPC ..... 114/312

(58) Field of Classification Search
USPC ..... 114/312–314
See application file for complete search history.

(56) References Cited

U.S. PATENT DOCUMENTS

| | | | | |
|---|---|---|---|---|
| 3,713,412 | A * | 1/1973 | Ianuzzi | 114/312 |
| 3,929,533 | A * | 12/1975 | Horn | 156/71 |
| 4,493,578 | A * | 1/1985 | D'Alessio | 403/49 |
| 6,321,676 | B1 * | 11/2001 | Kohnen et al. | 114/312 |
| 2005/0185816 | A1 * | 8/2005 | Roark et al. | 381/400 |

* cited by examiner

*Primary Examiner* — Stephen Avila
(74) *Attorney, Agent, or Firm* — Mitchell P. Brook; McKenna Long & Aldridge LLP

(57) ABSTRACT

A dome assembly comprises an upper hemispherical window having a first end surface with an upper ring assembly sealingly connected to the upper hemispherical window at or near the first end surface and a lower hemispherical window having a second end surface with a lower ring assembly sealingly connected to the lower hemispherical window at or near the second end surface. The dome assembly further comprises a spider retainer assembly comprising a spider ring assembly and one or more saddle arms having a first end and a second end with each saddle arm fixedly attached to the spider ring assembly at a first end and fixedly attached to one or more of the upper ring assembly and the lower ring assembly at a second end.

16 Claims, 15 Drawing Sheets

SEALABLE DOME ASSEMBLY

CROSS-REFERENCE TO RELATED APPLICATIONS

This application claims priority to U.S. Provisional Patent Application Ser. No. 61/386,906, filed Sep. 27, 2010, which is hereby incorporated by reference in its entirety.

FIELD

The present invention relates to a sealable dome assembly.

BACKGROUND

Underwater craft provide opportunities for scientific exploration and for individuals to view oceans and marine life. Although various types of passenger and operator compartments and various forms of hatches and sealing mechanisms can be used, a full acrylic cabin with an upper and lower hemisphere provides the best visibility for the passenger. In this type of cabin, the entire upper hemisphere can be used as a hatch, which allows easy entry and exit from the cabin and greater control of cabin temperature and humidity.

Assemblies for full acrylic cabins generally comprise two hemispheres mounted on one or more metallic rings. All structural attachments are made to the metal rings, leaving the acrylic windows clear for passenger viewing. The hemispheres typically are mounted onto the rings by incorporating an equatorial flange into each hemisphere and holding the hemispheres down on the ring by a retainer ring installed on top of the flange. While this type of mechanism could be used for underwater craft rated for deeper submersion, it would substantially reduce visibility for the passengers. This is because deeper rated submersibles require thicker acrylic domes and thicker equatorial flanges, which would in turn require the metal mounting ring height to increase proportionally. The resulting higher rings would reduce visibility from the cabin.

Attempted solutions include dome assemblies using various flangeless sealing mechanisms. Known methods of holding down flangeless domes can effectively seal spherical windows of 90° or 120° using a large retainer ring near the base. However, such systems suffer from the disadvantage of reduced visibility when used with 180° domes. This is because the retainer ring cannot be near the base as this does not provide sufficient axial restraint and requires a mechanical system to hold a retainer ring further up the window towards the apex.

Other known systems that use retainer rings for acrylic windows also have disadvantages. One such system uses a compounded window system holding a NEMO type window in place with a tie-rod system, together with a secondary tie-rod system holding down a hyper-hemisphere. This system is inherently unstable and provides only marginal control over the window when exposed to compressive, thermal, lateral or vertical loading. It is very difficult to maintain preload on the window because it has to rely on the stability of the tie rods. Tie rods often need to have a separate spring system to maintain sufficient tension. Moreover, this tie-rod arrangement becomes obstructive for viewing when a 180° hemispherical dome is used. Other known systems for a large hemispherical dome use a series of belts or a bridge system and a contact point at the apex to hold down the acrylic window. However, both of these systems have the drawback of a significantly obstructed view.

Therefore, there exists a need for a system that can provide a sealing mechanism for full acrylic cabins that imparts sufficient stability for underwater craft rated for deeper submersion. There is a further need for a sealing mechanism for full acrylic cabins that does not compromise cabin visibility by increasing mounting ring height. Specifically, there is a need for a flangeless sealing mechanism for full acrylic underwater craft cabins that uses an entire upper hemisphere as a hatch and maintains good cabin visibility.

SUMMARY

The present invention, in its many embodiments, alleviates to a great extent the disadvantages of known sealable dome assemblies by providing a sealable dome having a sealing assembly that uses an O-ring seal and a "spider" saddle arm structure. Embodiments of the dome assemblies disclosed provide a lower hemispherical window secured to a mounting ring assembly by a sealably connecting O-ring seal. The mounting ring assembly is fixedly attached to a spider retainer assembly by one or more saddle arms, and in exemplary embodiments, extends adjacent the sides and back of the upper hemispherical window and/or the lower hemispherical window. An arrangement with the sadlle arms extending on the upper hemispherical window maintains visibility of both the upper hemisphere and the front half of the lower hemisphere of the dome. In addition, because embodiments of the disclosed spider retainer assembly are substantially rigid, they provide pure axial displacement control on the acrylic dome. They also impart radial, lateral and rotational stability to the dome.

Embodiments of the disclosure include a dome assembly comprising an upper hemispherical window having a first end surface and a lower hemispherical window having a second end surface. An upper ring assembly is sealingly connected to the upper hemispherical window at or near the first end surface of the section, and a lower ring assembly is sealingly connected to the lower hemispherical window at or near the second end surface. The lower ring assembly may comprise a lower forging or equatorial ring and a lower retainer ring fastened to the lower equatorial ring.

In some embodiments, the lower equatorial ring has a base seat structure. A gasket may be attached to the lower equatorial ring and disposed between the lower equatorial ring and the second end surface of the lower hemispherical window of the dome assembly. At least one O-ring seal is disposed between the base seat and the lower hemispherical window. The O-ring seal provides a sealing connection between the lower equatorial ring and the lower hemispherical window of the dome assembly and acts as a centering mechanism to center the hemispherical windows. In exemplary embodiments, the gasket is made of a substantially hard material. The lower retainer ring holds the O-rings in place and helps to center the hemispherical windows.

The upper ring assembly may comprise an upper ring and an upper retainer ring fastened to the upper ring. A sealing mechanism for the upper hemispherical window may include a small flange at the first end surface of the section. It is desirable to have a small flange in view of the thickness of the hemispherical windows. In some embodiments, a substantially hard gasket may be attached to the upper ring and disposed between the upper ring and the first end surface of the upper hemispherical window. In addition, a substantially soft gasket may be disposed between the upper retainer ring and the flange. The flange, the substantially soft gasket, the upper ring and the upper retainer ring form a sealing connection between the upper ring and the upper hemispherical window.

Embodiments of the dome assembly further comprise a spider retainer assembly. The spider retainer assembly may include a spider ring assembly and one or more saddle arms. The saddle arms have a first end and a second end, and each saddle arm is fixedly attached to the spider ring assembly at a first end and fixedly attached to one or more of the upper ring assembly and the lower ring assembly of one or more of the upper hemispherical window and the lower hemispherical window at a second end. In addition, each saddle arm may be spaced apart from the other saddle arms. In an exemplary embodiment, there are three saddle arms, with two saddle arms extending adjacent the side of one or more of the upper hemispherical window and the lower hemispherical window and a third saddle arm extending adjacent the rear of one or more of the upper hemispherical window and the lower hemispherical window.

In exemplary embodiments, the spider ring assembly comprises a substantially rigid thrust ring, a spider retainer ring and a gasket. The spider retainer ring and the gasket fasten the thrust ring to one or more of the upper hemispherical window and the lower hemispherical window of the dome assembly. The gasket may be made of a substantially soft material, and the retainer ring makes contact with one or more of the upper hemispherical window and the lower hemispherical window through this cushion material.

Embodiments of disclosed sealing assemblies for sealing a ring to a first component comprise a ring and a retainer ring fastened to the ring. The ring has a substantially flat bottom surface and a base seat. A gasket is attached to the ring and disposed between the bottom surface of the ring and the first component. Exemplary sealing assemblies also include at least one O-ring seal disposed between the base seat and the first component. The O-ring seal provides a sealing connection between the ring and the first component. In exemplary embodiments, the gasket is made of a substantially hard material.

The disclosed sealing assemblies can be used in any context to seal a ring to another component, and in an exemplary application the first component is a lower hemispherical window of a dome assembly. The dome assembly may include an upper hemispherical window and a bottom retainer assembly. The bottom retainer assembly may comprise a bottom ring assembly and one or more saddle arms having a first end and a second end. Each saddle arm is fixedly attached to the bottom ring assembly at a first end and fixedly attached to the ring at a second end.

An underwater craft also is disclosed herein. The underwater craft comprises a support structure, a buoyancy system and a sealable chamber mounted on the support structure. The sealable chamber has an interior and a first operator station within the interior. The craft may have a second operator station outside the sealable chamber interior. For example, the sealable chamber comprises an upper hemispherical window having a first end surface and a lower hemispherical window having a second end surface. An upper ring assembly is sealingly connected to the upper hemispherical window at or near the first end surface of the section, and a lower ring assembly is sealingly connected to the lower hemispherical window at or near the second end surface. The lower ring assembly may comprise a lower ring and a lower retainer ring fastened to the lower ring.

In exemplary embodiments, the lower equatorial ring of the sealable chamber has a base seat structure. A gasket may be attached to the lower equatorial ring and disposed between the lower equatorial ring and the second end surface of the lower hemispherical window of the dome assembly. At least one O-ring seal is disposed between the base seat and the lower hemispherical window. The O-ring seal provides a sealing connection between the lower equatorial ring and the lower hemispherical window of the dome assembly. In exemplary embodiments, the gasket is made of a substantially hard material.

The upper hemispherical window of the sealable chamber may comprise an upper ring and an upper retainer ring fastened to the upper ring. A sealing mechanism for the upper hemispherical window may include a flange at the first end surface of the section. In some embodiments, a substantially hard gasket may be attached to the upper ring and disposed between the upper ring and the first end surface of the upper hemispherical window. In addition, a substantially soft gasket may be disposed between the upper retainer ring and the flange. The flange, the substantially soft gasket, the upper ring and the upper retainer ring form a sealing connection between the upper ring and the upper hemispherical window.

Embodiments of the underwater craft's sealable chamber further comprise a spider retainer assembly. The spider retainer assembly may include a spider ring assembly and one or more saddle arms. The saddle arms have a first end and a second end, and each saddle arm is fixedly attached to the spider ring assembly at a first end and fixedly attached to one or more of the upper ring assembly and the lower ring assembly of one or more of the upper hemispherical window and the lower hemispherical window at a second end. In addition, each saddle arm may be spaced apart from the other saddle arms. In an exemplary embodiment, there are three saddle arms, with two saddle arms extending adjacent the side of one or more of the upper hemispherical window and, the lower hemispherical window and a third saddle arm extending adjacent the rear of one or more of the upper hemispherical window and the lower hemispherical window.

In exemplary embodiments, the spider ring assembly of the sealable chamber comprises a substantially rigid thrust ring, a spider retainer ring and a gasket. The spider retainer ring and the gasket fasten the thrust ring to one or more of the upper hemispherical window and the lower hemispherical window of the dome assembly. The gasket may be made of a substantially soft material, and the retainer ring makes contact with one or more of the upper hemispherical window and the lower hemispherical window through this cushion material.

Thus, embodiments of the disclosure provide sealable domes for underwater craft having a flangeless sealing assembly that maintain maximum passenger visibility through the dome. Embodiments of the dome assemblies disclosed provide a lower hemispherical window secured to a mounting ring assembly by a sealably connecting O-ring seal and a substantially rigid saddle arm structure. These and other features and advantages of the present invention will be appreciated from review of the following detailed description of the invention, along with the accompanying figures in which like reference numerals refer to like parts throughout.

BRIEF DESCRIPTION OF THE DRAWINGS

The foregoing and other objects of the invention will be apparent upon consideration of the following detailed description, taken in conjunction with the accompanying drawings, in which.

DETAILED DESCRIPTION

Figure 1:
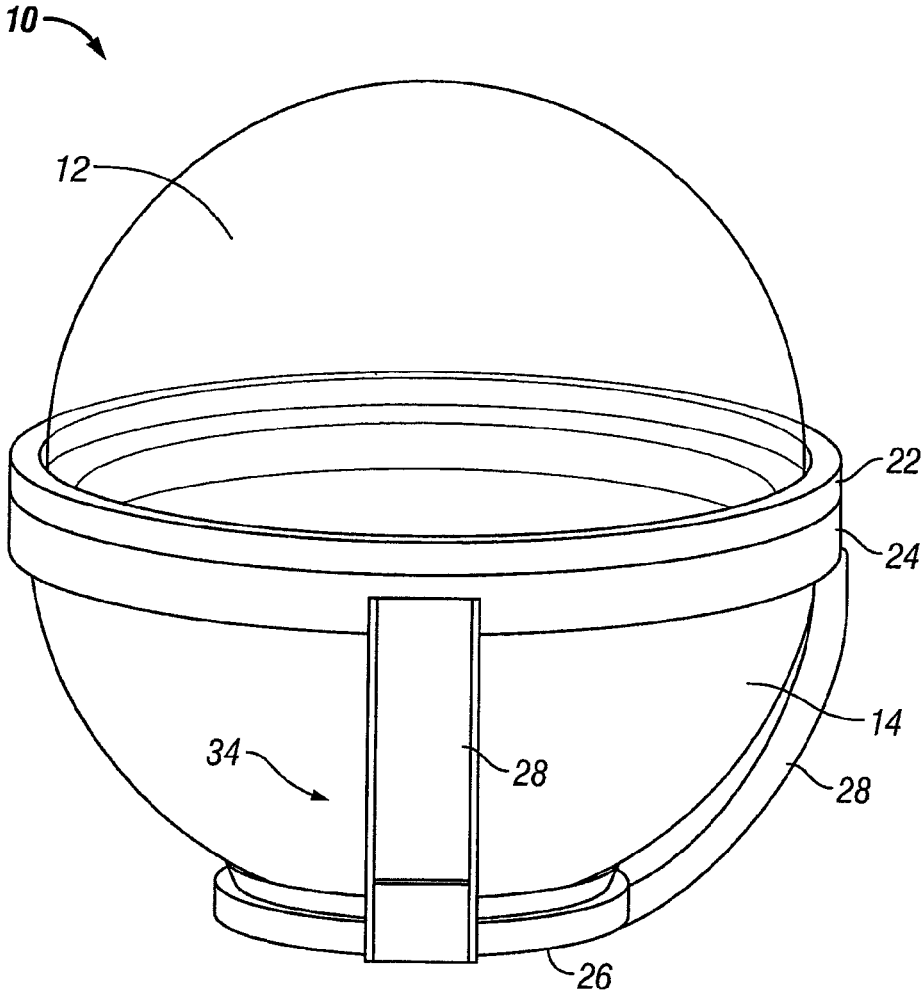
FIG. 1 is a perspective view of an embodiment of a sealable dome assembly in accordance with the present disclosure.
Figure 2A:
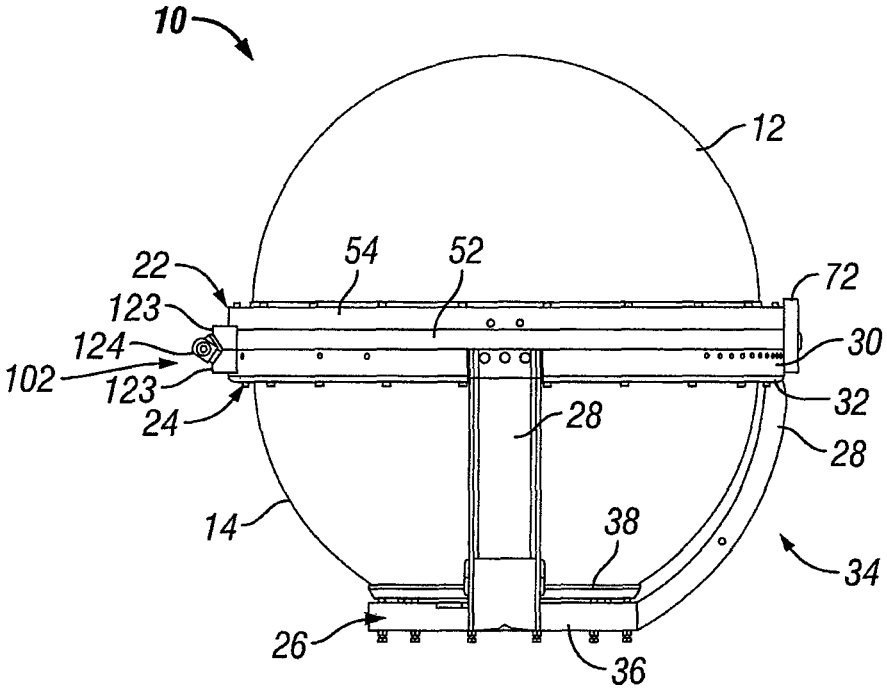
FIG. 2A is a side view of an embodiment of a sealable dome assembly in accordance with the present disclosure.
Figure 2B:
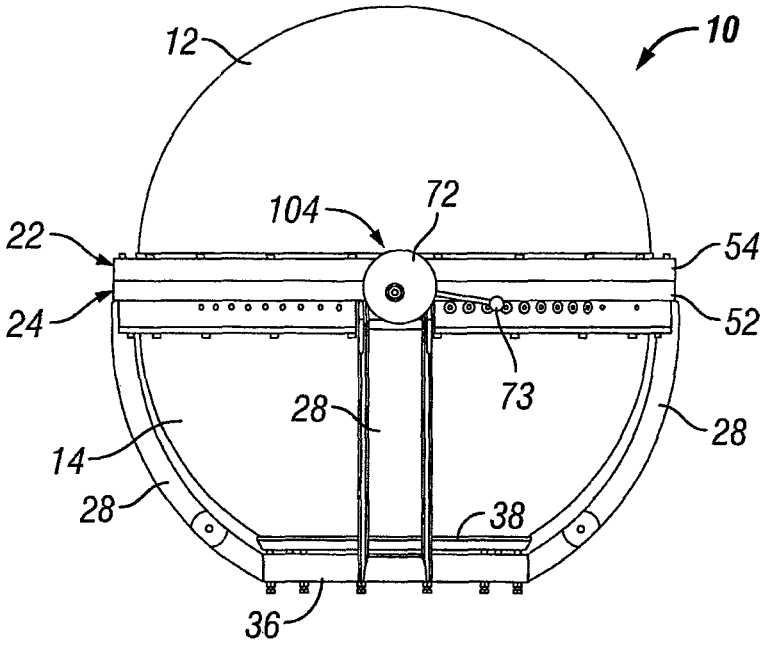
FIG. 2B is a rear view of an embodiment of a sealable dome assembly in accordance with the present disclosure.
Figure 2C:
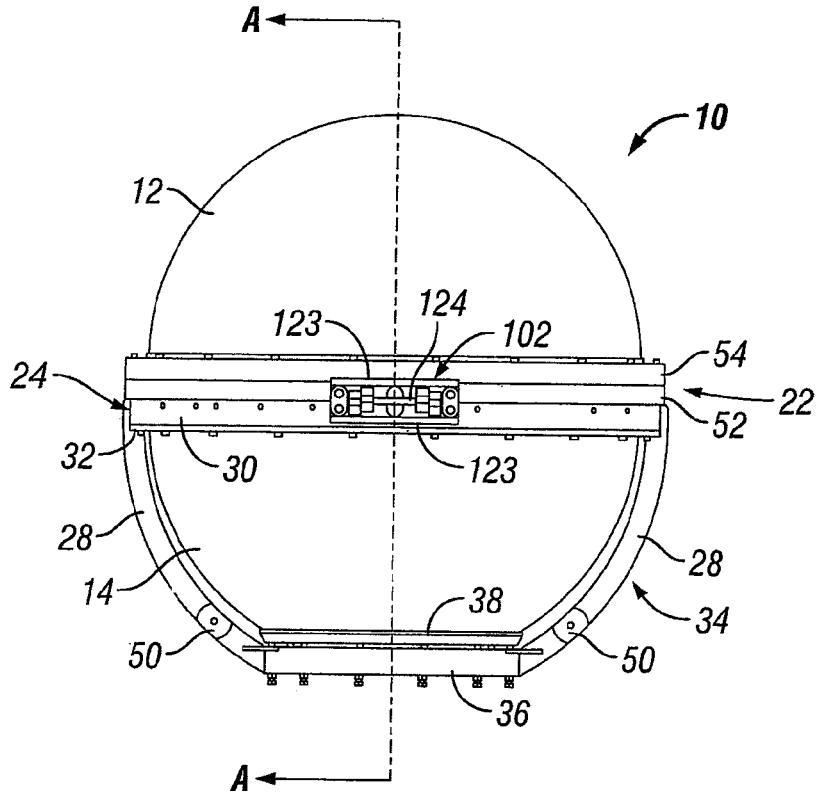
FIG. 2C is a front view of an embodiment of a sealable dome assembly in accordance with the present disclosure.
Figure 2D:
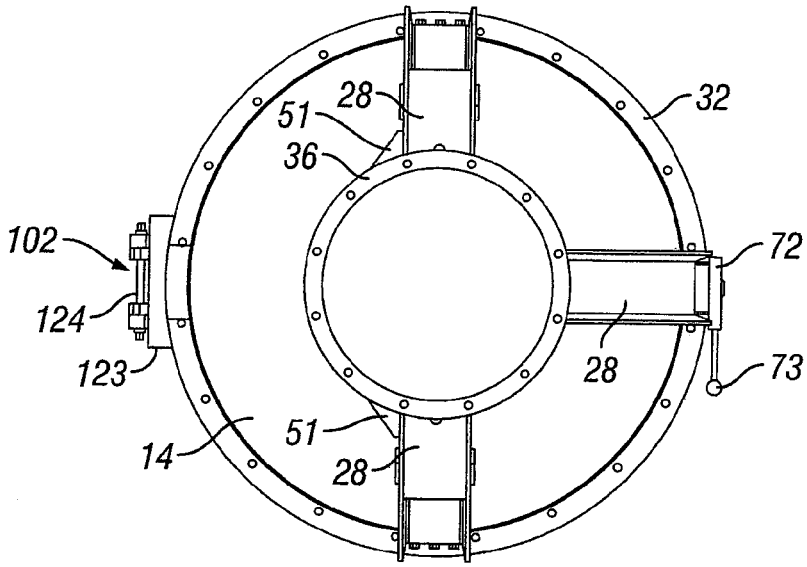
FIG. 2D is a bottom view of an embodiment of a sealable dome assembly in accordance with the present disclosure.
Figure 3:
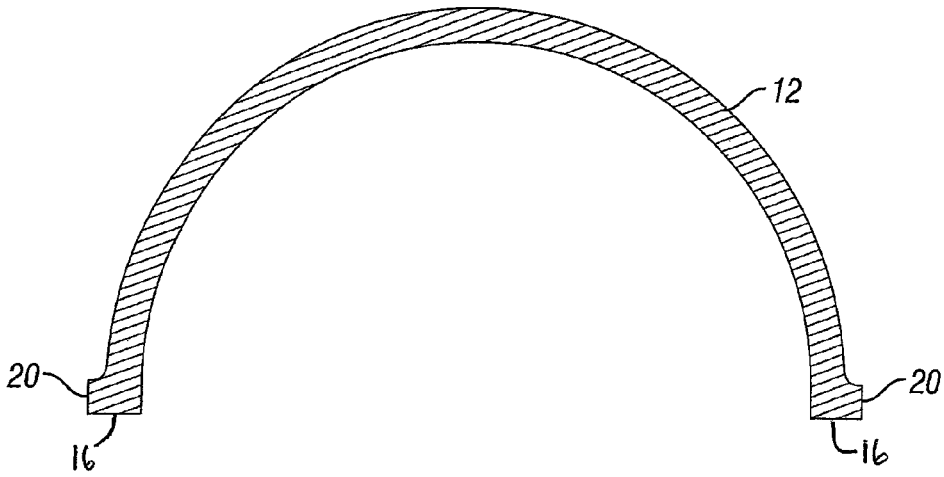
FIG. 3 is a cross-sectional view of an embodiment of an upper hemispherical window of a sealable dome assembly in accordance with the present disclosure.
Figure 4:
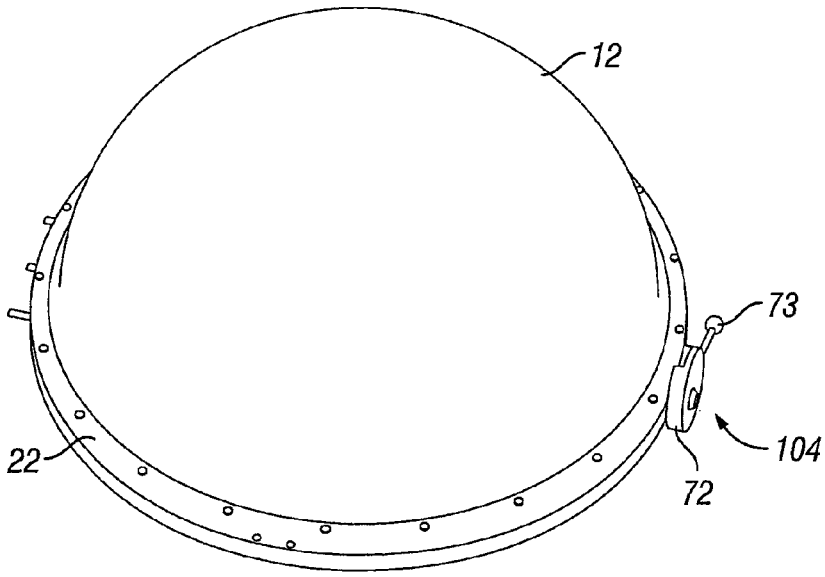
FIG. 4 is a perspective view of an embodiment of an upper hemispherical window and an upper ring assembly of a sealable dome assembly in accordance with the present disclosure.

In the following paragraphs, embodiments will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations on the present invention. As used herein, the "present disclosure" refers to any one of the embodiments described herein, and any equivalents. Furthermore, reference to various aspects of disclosed embodiments throughout this document does not mean that all claimed embodiments or methods must include the referenced aspects. Reference to temperature, pressure, density and other parameters should be considered as representative and illustrative of the capabilities of embodiments of the invention, and embodiments can operate with a wide variety of such parameters.

Referring to FIGS. 1-4, an embodiment of a dome assembly is shown. A substantially round dome is shown, but the shape may be modified depending on the application. Dome assembly 10 includes upper hemispherical window 12, lower hemispherical window 14, upper ring assembly 22 and lower ring assembly 24. The upper and lower pressure ring assemblies 22, 24, which may be made of aluminum; serve to integrate the hemispherical windows 12, 14. As best seen in the cross-section shown in FIGS. 3 and 7, upper hemispherical window 12 has a first end surface 16, and lower hemispherical window 14 has a second end surface 18. Upper and lower hemispherical windows 12, 14 may be of any size as long as a sufficiently sized access aperture is provided for the size of passenger, cargo or equipment desired.

Figure 10:
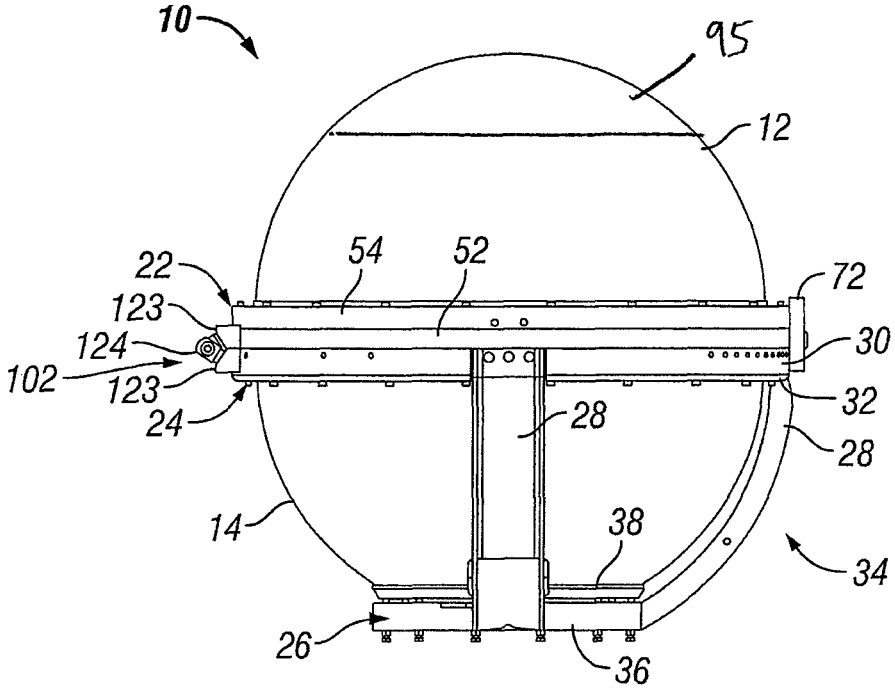
FIG. 10 is a side view of an embodiment of sealable dome assembly in accordance with the present disclosure.

The two hemispherical windows 12, 14 and the upper and lower ring assemblies 22, 24 form the main pressure vessel ("MPV"), or cabin (MPV, cabin, dome assembly and sealable chamber will be used interchangeably herein), of the underwater craft. Penetrations into the MPV may be effected through the ring assemblies. Alternatively, the dome may be accessed by other mechanisms such as a penetrator plate in one or both of the upper or lower hemispherical windows 12, 14 or by having the full dome be an openable hatch. Another alternative, an exemplary embodiment of which is shown in FIG. 10, is having a hatch 95 in one or both of the upper and lower hemispherical windows 12, 14 or an emergency or other egress/ingress hatch in one or both sections. Such a hatch also can be used as a service hatch to allow access to the interior of the dome when for example the vehicle is stored in a hanger having a low clearance where the dome cannot be fully opened about the equatorial hinge. In one example the hatch would have a diameter of approximately 24-26 inches or other diameter providing a sufficient perimeter for a person to fit through. The hemispherical windows 12, 14 are installed onto the ring assemblies 22, 24 as windows and typically do not provide any structural function to the submersible. In exemplary embodiments, upper hemispherical window 12 has an equatorial flange 20 that extends around the circumference of the section. The dome assembly further comprises a spider retainer assembly 34 having a spider ring assembly 26 and one or more saddle arms 28 which fixedly connect the spider ring assembly 26 to the lower ring assembly 24.

Figure 5:
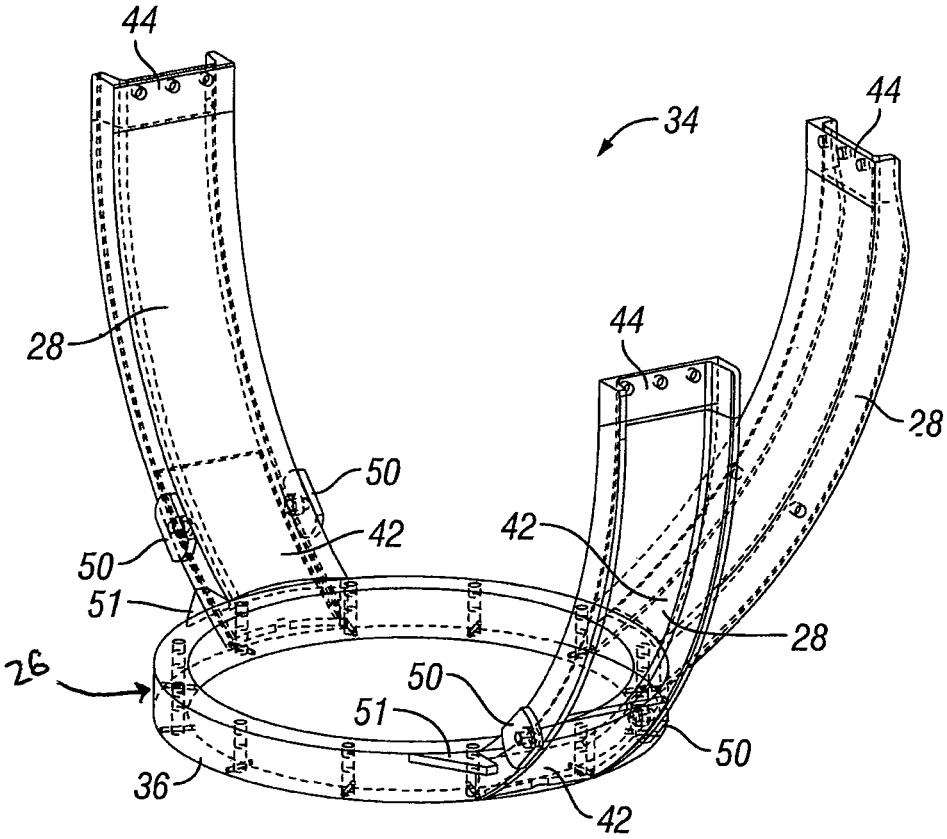
FIG. 5 is a perspective view of an embodiment of a retainer assembly in accordance with the present disclosure.
Figure 6:
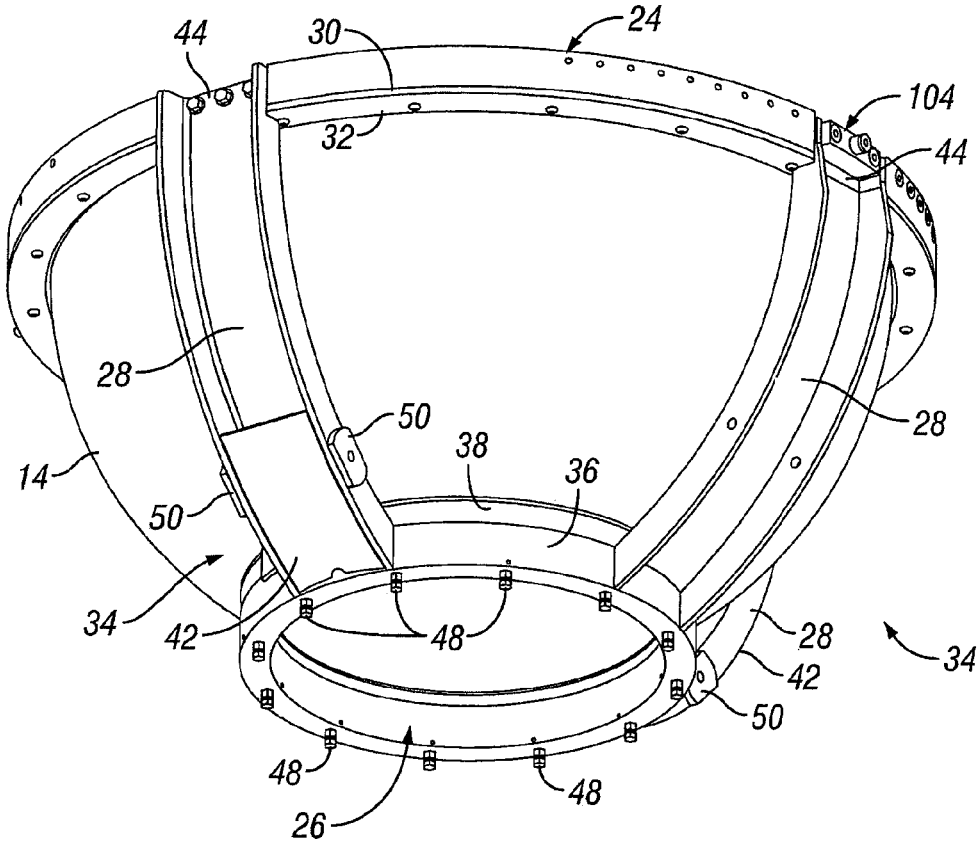
FIG. 6 is a perspective view of an embodiment of a retainer assembly and a bottom ring assembly in accordance with the present disclosure.

The dome assembly further comprises a spider retainer assembly 34 having a spider ring assembly 26 and one or more saddle arms 28 which fixedly connect the spider ring assembly 26 to the lower ring assembly 24. Referring to FIGS. 5-8, the saddle arms 28 and bottom ring assembly 26 are shown in embodiments having a spider retainer assembly 34 adapted to connect with the lower hemispherical window 14. Each saddle arm 28 has a first end 42 and a second end 44 and is fixedly attached, by welding or other known methods, to the spider ring assembly 26 at the first end of the saddle arm. Gussets 51 may be used to reinforce the connection between the saddle arms 28 and the spider ring assembly 26. The second end 44 of each saddle arm 28 is fixedly attached to lower ring assembly 24. Each saddle arm 28 may have a bushing 50, for example, one on each side as shown in FIGS. 5 and 6, to constrict and restrain motion of the saddle arm 28. The lower equatorial retainer 32 is held to equatorial ring 30 through any suitable fastening mechanism, and also is an equatorial ring. Generally speaking, lower equatorial retainer 32 is made of a non-metallic material.

Figure 8:
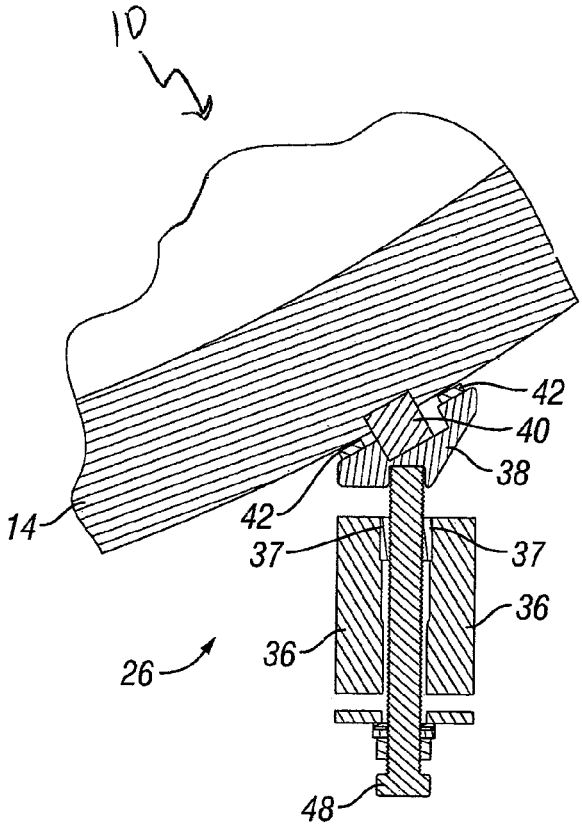
FIG. 8 is a cross-sectional view showing a connection point between an embodiment of a bottom retainer assembly and an embodiment of lower hemispherical window of a sealable dome assembly in accordance with the present disclosure.

Embodiments of the spider ring assembly 26 comprise thrust ring 36, which is a substantially rigid structure, and a spider retainer ring 38. Any suitable mechanism could be used to provide preload on dome 10. As shown in FIG. 8, one such mechanism is gasket 40. Gasket 40 may be made of a substantially soft material such as silicon, but other soft materials suitable for gaskets may be used. Alternatively, a rigid plastic component could be used instead of a gasket. Another alternative to provide preload on the dome is a spring mechanism between bolt 48 and thrust ring 36.

Bottom retainer assembly 34, which includes bottom ring assembly 26 and saddle arms 28, forms a substantially rigid assembly that holds the lower hemispherical window 14 of the dome assembly 10 firmly in place. In exemplary embodiments, three saddle arms 28 (two on the side and one on the rear) provide a solid connection from the bottom thrust ring 36 to the lower equatorial retainer ring 32. The thrust ring 36 forms the base onto which the bottom retainer ring 38 sits, and along with lower equatorial retainer ring 32, keeps lower hemispherical window 14 centered. Thrust ring 36 may be designed to be rigid enough to allow the lower equatorial ring 30 to be pre-loaded against the window and form the base of the window such that the window sits on the equatorial ring 30. The entire bottom retainer assembly 34 is substantially rigid and provides pure axial displacement control on the acrylic dome. It also provides radial, lateral and rotational stability to the dome. The size and mass of the bottom retainer assembly are designed to provide stiffness to the structure, independent of the upper and lower hemispherical windows, i.e., the window of the dome.

Figure 7:
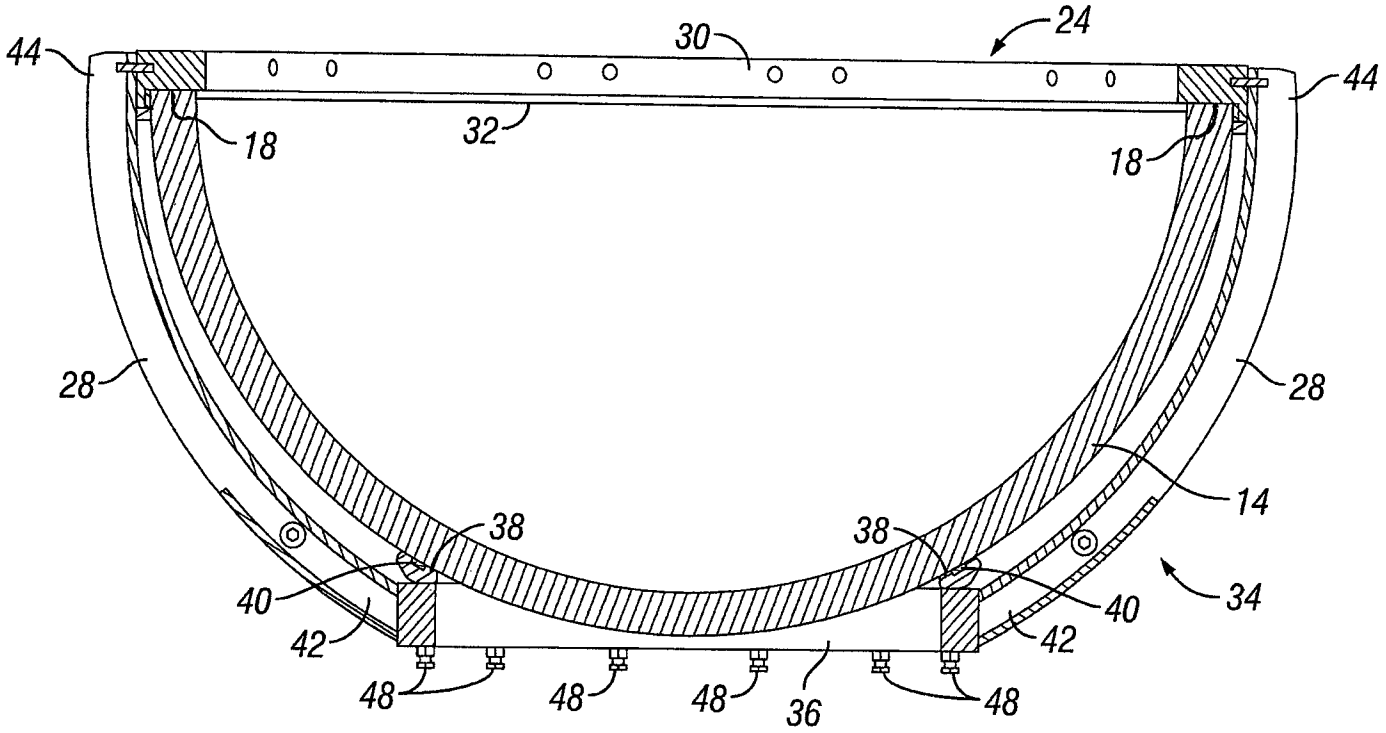
FIG. 7 is a cross-sectional view of the bottom half of an embodiment of a sealable dome assembly in accordance with the present disclosure.

As shown in FIGS. 7 and 8, the spider retainer ring 38 and gasket 40 serve to fasten thrust ring 36 to the lower hemispherical window 12. The width of the contacting gasket 40 is designed to optimize both the preload pressure and the stroke of the soft gasket. Bolt 48 extends through thrust ring 36, is held by threaded inserts 37, and is used to adjust the preload pressure on the bottom retainer ring 38 and the lower hemispherical window 14. Bottom retainer ring 38 acts as a carrier here to hold gasket 40 in place such that only gasket 40 contacts lower hemispherical window 14. The dimension, hardness and preload condition of gasket 40 are all designed to ensure constant contact between the lower hemispherical window 14 and the soft gasket 40 under all operating conditions. In particular, gasket 40 may be rigid and bolt 48 be soft, or gasket 40 may be soft and bolt 48 be rigid and threaded to provide spring load and ensure that gasket 40 and lower hemispherical window 14 remain in constant contact. In either case, one of gasket 40 and bolt 48 is spring-loaded. Retainer ring stops 42 may be mounted on the bottom retainer ring 38 on either side of and adjacent to lower soft gasket 40 to provide a mechanical stop and prevent over compression of the lower soft gasket 40.

Lower thrust ring 36 and bottom retainer ring 38 hold lower hemispherical window 14 in place by limiting the motion of the dome in its axial displacement. The diameters of lower thrust ring 36 and bottom retainer ring 38 may be small enough to effectively transfer as much of the normal pressure on the dome in the axial direction. In exemplary embodiments, the dome is held at the apex, where 100% of the normal holding force is in the axial direction. It also may be desirable for the diameters of the lower thrust, ring 36 and bottom retainer ring 38 to be large enough to provide extra stability around the dome and apply the pressure over a large enough surface area to minimize the normal pressure on the acrylic.

Figure 9:
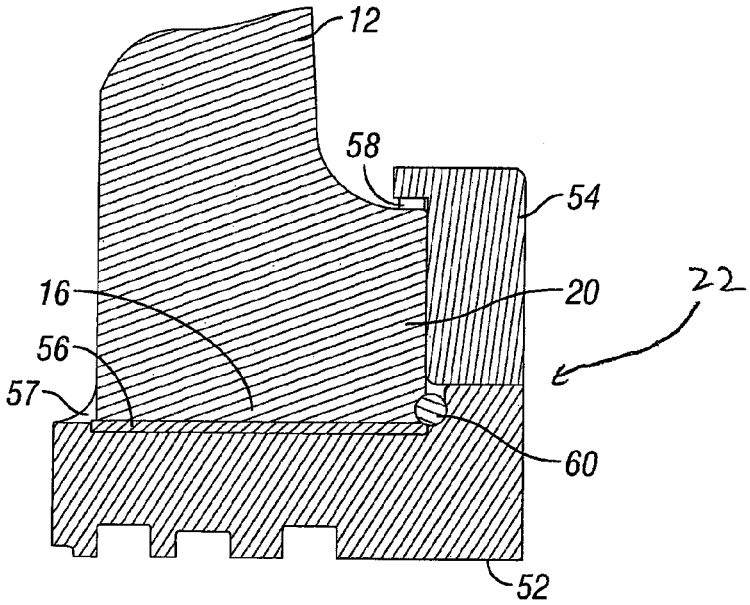
FIG. 9 is a cross-sectional view of an embodiment of an upper ring sealing assembly in accordance with the present disclosure.

Embodiments of an upper ring assembly sealing mechanism will be described with reference to FIG. 9, where the upper ring assembly 22 is shown in cross-section. Upper ring assembly 22 comprises an upper ring 52 and an upper retainer ring 54 fastened to the upper ring. Upper ring assembly 22 is fixedly attached to upper hemispherical window 12 at or near the first end surface 16. The first end surface 16 of upper hemispherical window 12 may have a flange 20 integrally formed on the upper hemispherical window. The flange 20 is an equatorial flange that extends around the circumference of the upper hemispherical window 12. Flange 20 is part of the sealing mechanism whereby upper hemispherical window 12 is sealed to upper ring assembly 22.

Equatorial flange 20 integrates the upper hemispherical window 12 onto upper ring 52, which seats the upper hemispherical window. Upper retainer 54 holds the upper hemispherical window 12 in place via the flange 20. A substantially hard upper gasket 56 is attached to the top of upper ring 52 and disposed between the upper ring and the upper portion of flange 20 to fill the space between the ring 52 and the section 12 and help provide a seal. A substantially soft upper gasket 58 is disposed between the upper retainer 54 and the equatorial flange 20 to provide a preload between upper retainer ring 54 and flange 20. The upper sealing mechanism also may include an upper O-ring seal 60 disposed between the upper hemispherical window 12 and the upper ring 52. Any suitable fastener may be used to secure upper retainer 54 to upper ring 52. The above-described upper sealing mechanism may extend around the entire circumference of the dome assembly 10 with the exception of the hinge 102 at the forward-facing end of the dome assembly and latching mechanism 104 at the rearward-facing end of the dome assembly.

The embodiment of upper ring assembly 22 described above with reference to FIG. 9 may extend around most of the circumference of the dome assembly 10. In addition, upper ring assembly 22 may vary in configuration at different specific locations on the dome assembly where the technical requirements differ.

Figure 11:
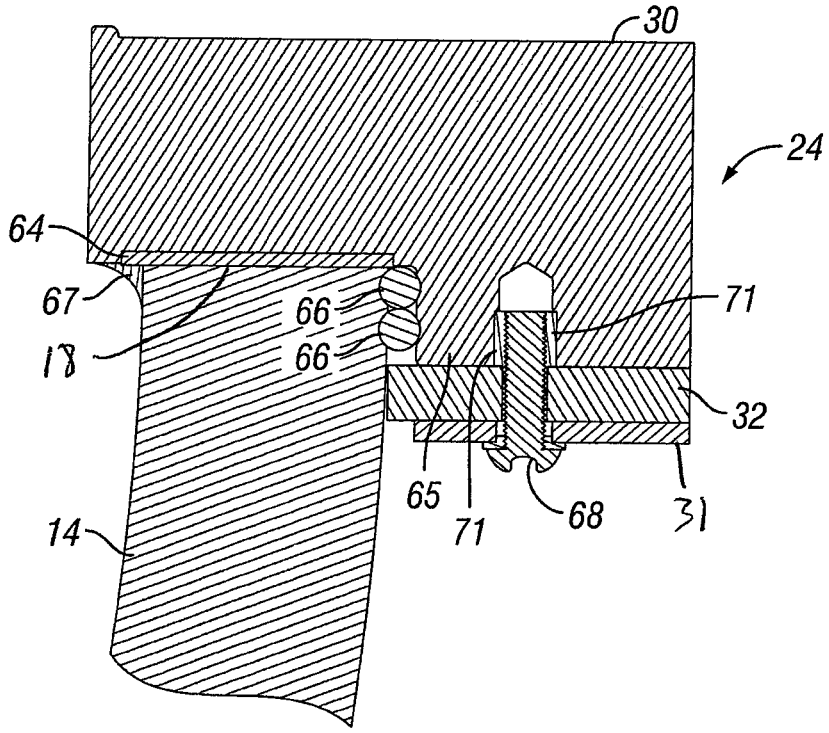
FIG. 11 is a cross-sectional view of an embodiment of a lower ring sealing assembly in accordance with the present disclosure.

Turning to FIG. 11, exemplary embodiments of a lower ring sealing mechanism will be described. Lower ring assembly 24 is fixedly attached to lower hemispherical window 14 at or near the second end surface 18, for example, through a hard gasket 64. The lower ring assembly 24 may include a lower equatorial, or forging, ring 30 and a lower equatorial retainer ring 32 fastened to the lower forging ring 30 through strip 31, which may be a singular ring, quadrant strips or other arrangements. Generally speaking in most embodiments, strip 31 is a metallic material and serves to retain in place lower retaining ring 32, and any arrangement or material may be used, which serves such purpose. In contrast to the upper ring assembly, lower ring assembly 24 seals lower hemispherical window 14 without a flange element. This design advantageously decouples the engineering parameters that traditionally link the height of the ring assembly with the thickness of the windows. The flangeless design allows the thicker windows required for deeper submersion while maintaining an MPV cabin design driven primarily by its mechanical interface requirements rather than the thickness of the window.

Lower hemispherical window 14 is seated on lower hard gasket 64 directly on the base of the lower ring 30. Lower ring 30 has a base seat 65, with one or more O-ring seals 66 disposed therein between the base seat and the outside surface of the lower hemispherical window. Base seat 65 is machined from a forging to have an outer ring around the dome which holds O-ring seals 66. O-ring seals 66 may be one, two or multiple O-ring seals 66, and the dual O-rings form the primary seal. O-ring seals 66 may vary in hardness and composition and assist in providing primary centering of lower hemispherical window 14. The lower hard gasket 64 on the base of the lower ring 30 acts as a secondary seal. Lower hard gasket 64 may be made of nylon or other suitable material. Lower retainer 32 mounts to lower ring 30, with any suitable fastener, such as through bolt 68 and, optionally threaded inserts 71, facilitating attachment, and provides secondary centering for the lower hemispherical window 14 and retains O-rings 66. The upper and lower rings 52 and 30 are the primary centering mechanisms of the dome assembly 10, and the upper and lower retainers 54 and 32 prevent additional overshoot in radial movement. With the radial movement controlled by lower ring 30 and O-ring 66, lower retainer 32 only needs to hold the O-rings in place and provide secondary centering.

Figure 12:
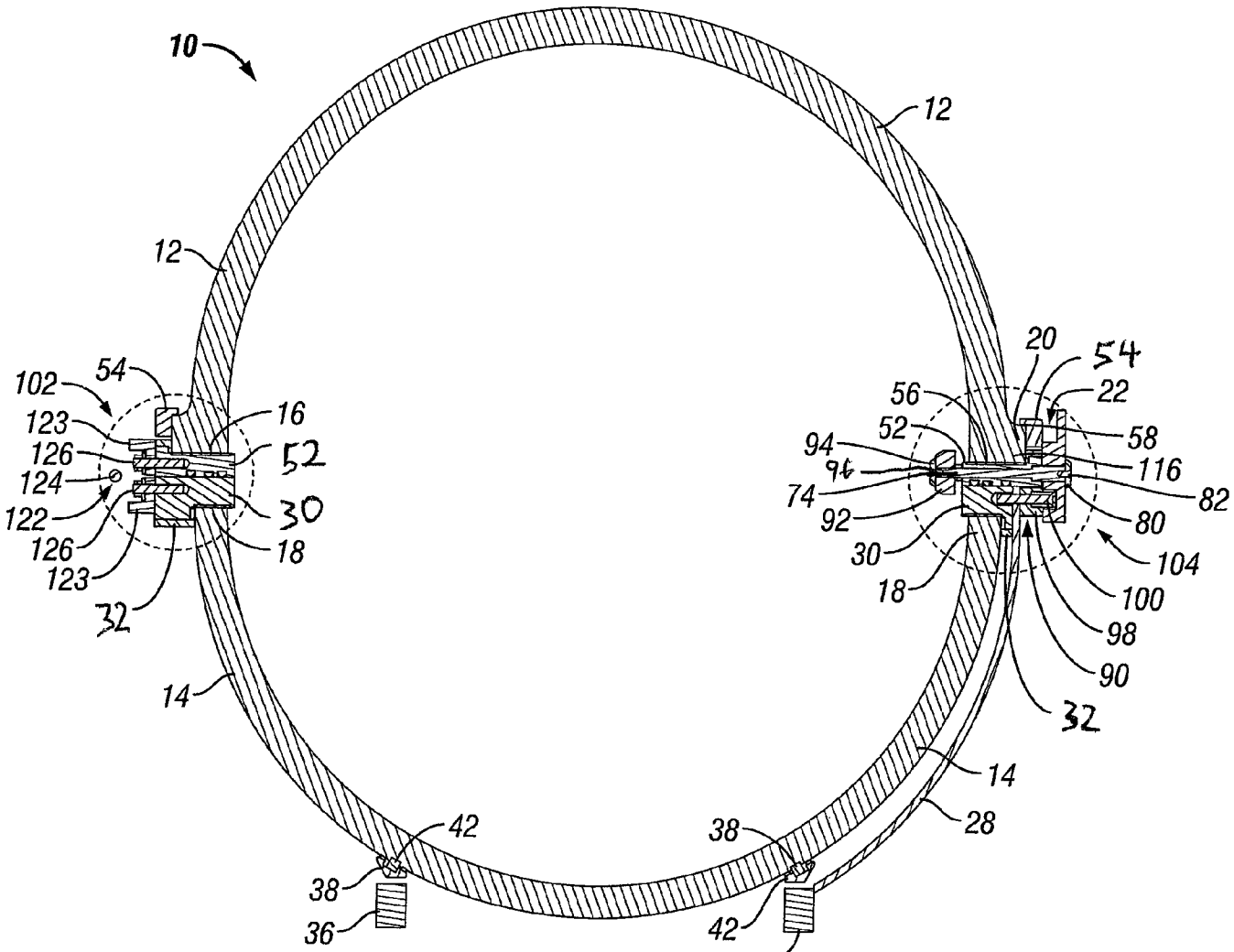
FIG. 12 is a cross-sectional view of an embodiment of a sealable dome assembly showing embodiments of a hinge assembly and a latching mechanism in accordance with the present disclosure.

FIG. 12 shows an exemplary embodiment of hinge assembly 102 at the front of dome assembly 10 and latching mechanism 104 at the rear of dome assembly 10. As described above, the upper and lower hemisphere sealing mechanisms extend around the circumference of dome assembly 10. Any suitable hinge assembly may be employed, and one exemplary embodiment of hinge assembly is described in U.S. Pat. No. 6,321,676, which is hereby incorporated by reference in its entirety. Exemplary embodiments of a hinge assembly may include a pin 124 and one or more hinge plates 123 with accompanying bolts 126 fastened to rings 52, 30.

Figure 13:
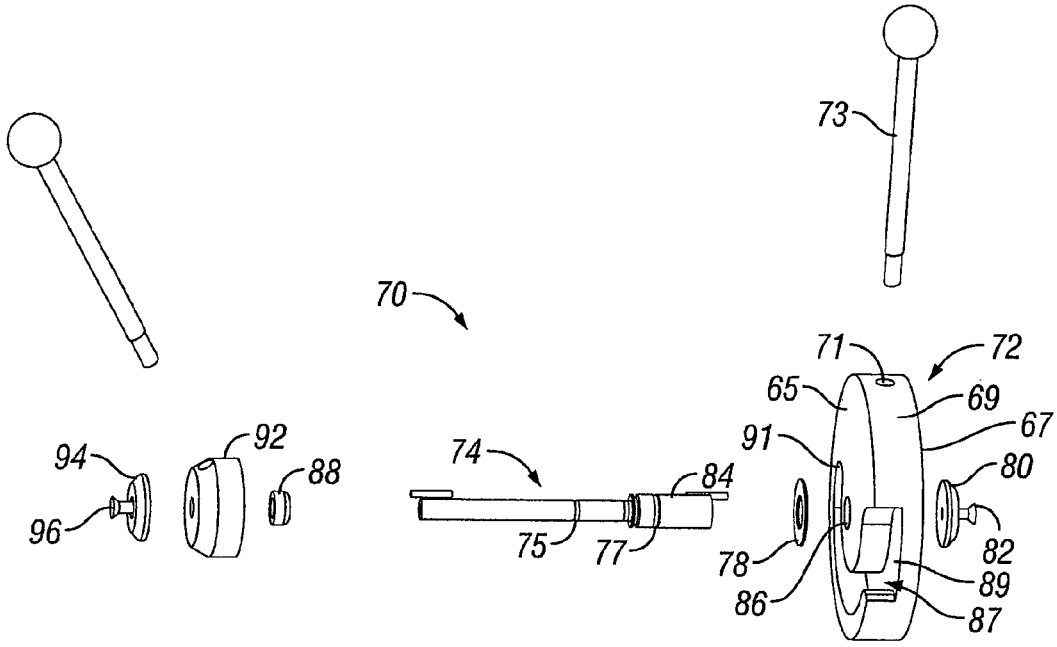
FIG. 13 is an exploded view of an embodiment of a latch hook assembly in accordance with the present disclosure.
Figure 14:
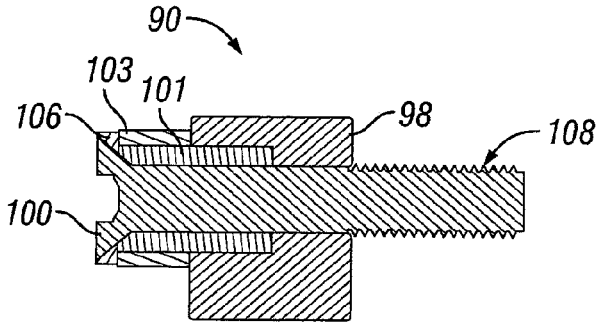
FIG. 14 is a cross-sectional view of an embodiment of a latch shim assembly in accordance with the present disclosure.

Turning to FIGS. 13-14, components of latching mechanism 104 of dome assembly 10 will be described. The latching mechanism incorporates the upper and lower sealing ring assemblies modified to accommodate the latching mechanism 104. Any form of latching mechanism may be used as long as it can serve to hold together upper and lower hemispherical windows 12, 14. A suitable latching mechanism is described in U.S. Pat. No. 6,321,676, which has been incorporated by reference herein. A major component of latching mechanism 104 is latch hook assembly 70, which extends through upper ring 252 at the location of the latching mechanism. Latch hook assembly 70 comprises sub-assemblies for latch hook 72, latch hook handle 73, latch hook pin 74 and latch hook inside plate 92.

In exemplary embodiments, latch hook 72 is a generally disc-shaped component having flat inside and outside surfaces 65, 67 and a rounded circumferential surface 69. As best seen in FIG. 13, latch hook 72 further defines a hole 71 at a point on its circumferential surface 69 to allow insertion of handle 73 and a center hole 86 extending through the flat surface from the inside surface 65 to the outside surface 67. An open channel 87 is defined through a portion of the inside surface 65 of latch hook 72 and has a proximal end 89 and a distal end 91. Channel 87 may extend approximately halfway around the inside surface 65 of latch hook 72. Proximal end 89 of channel 87 opens into circumferential surface 69 of latch hook 72.

Pin 74 may have thicker portion 84 at its proximal end which fits into receiving hole 86 of latch hook 72. This thickening of pin 74 provides more shear strength. O-rings 75 and 77 may be installed on the middle and thicker portion 84, respectively, of latch hook pin 74. Each O-ring 75 and 77 may be installed in a machined groove on the surface of pin 74. Latch hook bushing 78 serves to prevent rubbing between latch hook 72 and main upper rings 52 and 54 and main lower rings 30 and 32. In addition, latch hook bushing 78 strengthens the connection between pin 74 and latch hook 72 and constricts and restrains the motion of latch hook 72. Fastener bolt 82 fits through a hole in the center of latch hook retainer plate 80 and fastens the retainer plate 80 to pin 74. An inside bushing 88 prevents inside plate 92 from rubbing against main upper rings 52 and 54 and main lower rings 30 and 32. Inside bushing 88 and inside plate 92 are securely fastened to the distal end of latch hook pin 74 by an inside retainer plate 94 and inside fastener bolt 96.

A second major component of latching mechanism 104 is latch shim assembly 90, shown in FIG. 14. Exemplary embodiments of a latch shim assembly 90 comprise latch shim block 98 and latch shim screw 100. Latch shim screw 100 is inserted into latch shim block 98 and extends therethrough. Screw 100 extends through saddle arm 28 and into lower ring 30 to secure latch hook assembly 70 to dome assembly 10. Latch shim pin 101 and shim 103 encircle part of the upper portion of screw 100, and latch shim stop 106 is provided to fill the space between shim 103 and the head of screw 100. Screw 100 may have teeth 108 on its surface at the lower portion.

Latch hook assembly 70 and latch shim assembly 90 are the primary components of the fully assembled latching mechanism 104. Latch hook 72 is outside the dome assembly, and hole 86 receives the proximal end of latch hook pin 74. Pin 74 extends through upper ring 52 such that the thicker portion 84 at the proximal end of pin 74 is outside the dome assembly, and the distal end of the pin 74 extends within the dome assembly 10. Inside the dome assembly, the inside retainer plate 94 and inside plate 92 are securely fastened to the distal end of latch hook pin 74 by fastener bolt 96 and inside bushing 88 provides added stability. In the latched position, the head of latch shim assembly 90 is disposed within the distal end 91 of channel 87 and is securely held in the channel by latch shim pin 101, shim 103 and latch shim stop 106. The distal end 91 of channel 87 is shaped such that the head of latch shim screw 100 overcams and cannot inadvertently open. The latch shim assembly 90 extends through saddle arm 28 and into lower ring 30 to secure latch hook 72 to the lower ring assembly. Latch shim assembly 90 serves to keep upper ring 52 and lower ring 30 sealed when the latching mechanism 104 is in the latched position.

The process of latching and unlatching the latching mechanism 104 will now be described. FIG. 12 shows the latching mechanism 104 in the closed position. When the latching mechanism is closed, the latch shim assembly 90 is securely held in the distal end 91 of channel 87. To open the latching mechanism 104, the user turns the handle 73 of latch hook 72 in a counter-clockwise direction, which dislodges the head of latch shim assembly 90 from its overcammed position in the distal end 91 of the channel 87 and urges the screw 100 from the distal end 91 of the channel to the proximal end 89 of the channel. As the inside edge of channel 87 moves in a counter-clockwise direction the channel 87 acts as a cam surface on latch hook pin 74. When latch hook 72 has been turned in a counter-clockwise direction such that latch shim assembly 90 is at the proximal end. 89 of the channel 87, the latching mechanism 104 is in an unlatched position with only sealing elements 130, 132 and 134 maintaining the seal between upper ring 52 and lower ring 30. At this point, the user lifts latch hook 72 by gripping handle 73 or other portions of the latch hook. This breaks the seals of sealing elements 130, 132 and 134, separating upper ring 52 and lower ring 30 and opening the dome assembly 10 by lifting the upper hemispherical window 12 of the dome.

To latch the latching mechanism, the user performs the above-stated steps in reverse. That is, the user lowers latch hook 72 and presses down so that sealing elements 130, 132 and 134 form a seal between ring 52 and lower ring 30. Then latch hook is rotated in a clockwise direction using handle 73 so that the channel 87 of the latch hook 72 moves along the head of latch shim assembly 90 and the screw 100 ends up in an overcammed position in the distal end 91 of channel 87. As this occurs, the gap between the internal diameter of channel 87 and thicker portion 84 of latch hook pin 74 narrows. In this latched position, the latching mechanism 104 locks the dome assembly 10.

Figure 15:
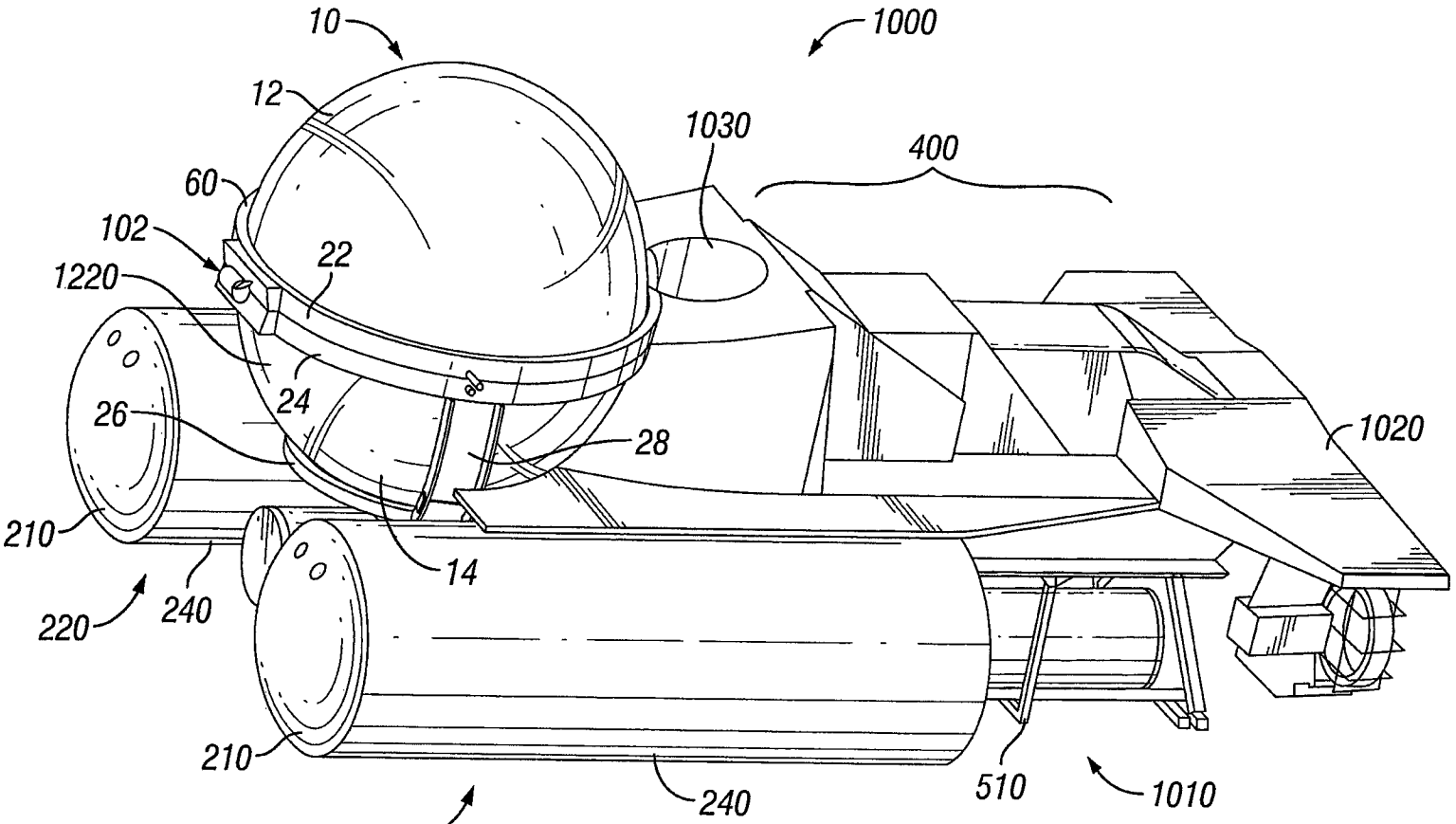
FIG. 15 is a side perspective view of an embodiment of an underwater craft in accordance with the present disclosure.
Figure 16:
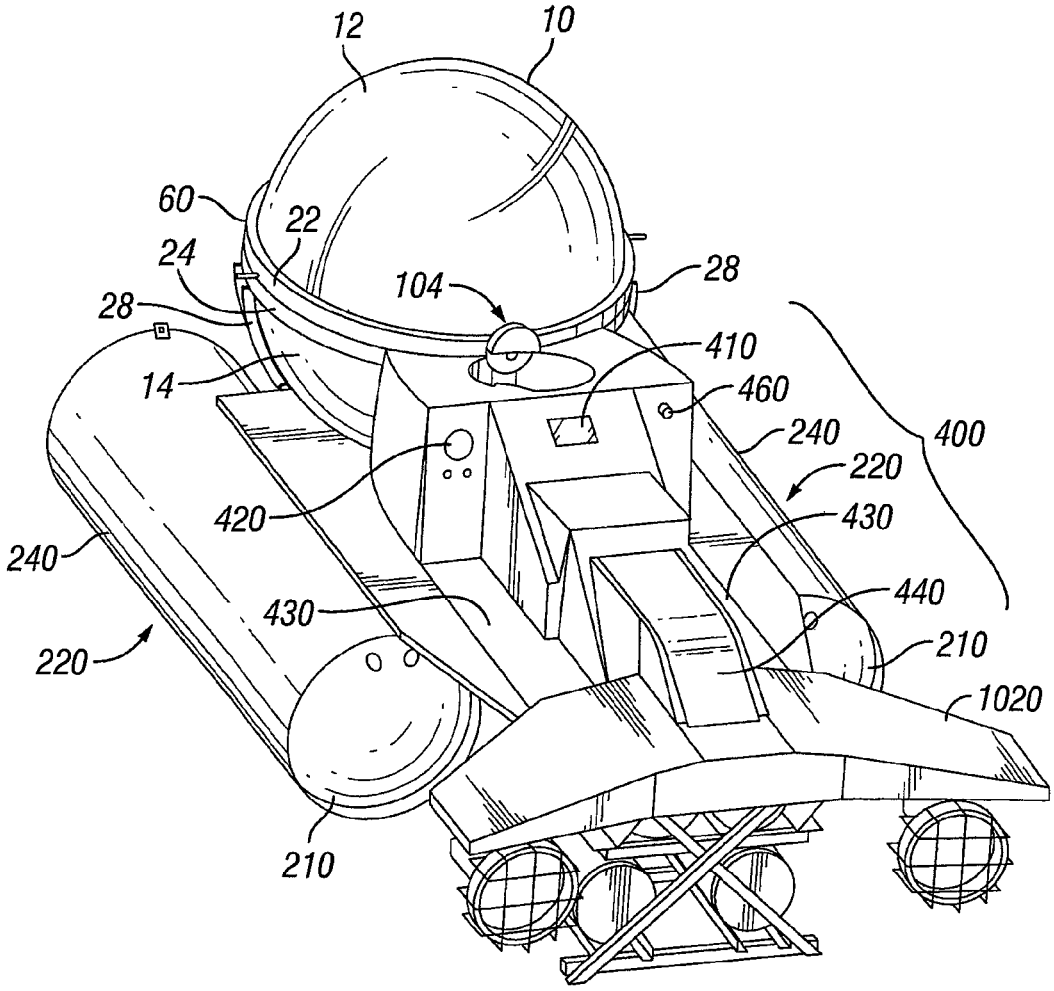
FIG. 16 rear top perspective view of an embodiment of an underwater craft in accordance with the present disclosure.

Embodiments of an underwater craft having a sealable dome assembly will be described with reference to FIGS. 15 and 16. Many features of disclosed underwater crafts are described in U.S. Pat. No. 6,321,676, which is hereby incorporated by reference in its entirety. Exemplary embodiments of an underwater craft 1000 comprise a frame section 510 provided as part of the support structure 1010 supporting various components. The tail section 1020 is connected to frame section 510. The external operator station 400 also is connected to the frame section 510. The knee and foot rests 430 and seating structure 440 may be constructed of molded fiberglass, although it is noted that any material and manufacturing process can be used. A vertical thruster 1030 may be provided.

The cabin 10 is split into two halves, a lower hemispherical window 14 fixedly mounted to the support structure 1010 and an upper hemispherical window 12 hingedly mounted, via upper ring assembly 22, to the lower section 14 using a hinge 102 via lower ring assembly 24. The hinge assembly 102 may be situated at any location on the cabin 10 and is shown here at the fore portion of the cabin 10 with a latch mechanism 104 is provided at the aft portion, approximately 180° around the center circumference of the sphere from the hinge assembly 102. Lower and upper sealing mechanisms operate as described above. Two cylindrical buoyancy chambers 220 are mounted generally beneath and to the side of the cabin 10, in a pontoon-like fashion.

Cabin 10 may be made of a clear material to allow passengers within the cabin 10 to have a wide field of view. For example, in exemplary embodiments, the entire upper hemispherical window 12 and the front half of the lower hemispherical window 14 are clear for passenger viewing. Any clear, generally water impermeable material may be used for the cabin 10, such as, for example, acrylic. In exemplary embodiments, the entire upper hemispherical window 12 opens to provide easy access to the interior of the cabin 10 for passengers.

The upper and lower hemispherical windows 12 and 14 of the cabin 10 are held in place using the sealing mechanisms described in detail above. A hinged aperture assembly 102 and latching mechanism 104 are provided for gaining access to the interior of the cabin. Upper ring assembly 22 is hingedly connected to lower ring assembly 24 using hinge assembly 102. Lower hemispherical window 14 is fixedly mounted to the support structure 1010 by some combination of attachments via lower ring assembly 24 and/or bottom retainer assembly 34. In operation of certain exemplary embodiments, upper hemispherical window 12 rotates about hinge 102 to open the cabin 10. To close the cabin 10, the upper hemispherical window 12 mates with the lower hemispherical window 14, and the two sections are held together by latching mechanism 104. Any form of latching mechanism may be used as long as it can hold together upper and lower hemispherical windows 12, 14 when latched. Appropriate latching mechanisms are described in U.S. Pat. No. 6,321,676, which has been incorporated by reference herein.

In exemplary embodiments, hinge assembly 102 is located at a side of the cabin 10 opposite from the other components of the underwater craft 1000 to provide for a free path of rotation for the upper hemispherical window 12 as it swings from a closed to an open position. Thus, as shown in FIG. 15, hinge assembly 102 is at the forward end of the cabin 10, farthest away from the tail section 1020 of the craft 1000 and at the front end of the craft.

The underwater craft 1000 is controlled from within the cabin 10. These controls include vertical thrust controls for adjusting the depth of the craft and mechanisms for controlling the buoyancy provided by a buoyancy control device. Other controls include for example, steering, internal atmosphere and speed of travel controls. Optionally, the controls can be located outside the sealable chamber 10, for external control, such as by a guide accompanying the craft. Controls may be provided within the sealable chamber 10, for control by passengers, as well as externally, for use in emergencies or for use by a diver or guide accompanying the underwater craft. External controls are particularly useful for training purposes or for providing tours to passengers who have no prior experience.

An external control station 400 is provided outside the sealable chamber 10. The external control station 400 may be located behind the sealable chamber 10, as illustrated in the figures, although it can be located at any position on the watercraft providing access to a person for operating external controls. The external control station 400 may be located behind the sealable chamber 10. This location promotes ease of viewing the passengers for the person operating the external controls, promotes viewing of the path of forward travel, and allows the external operator to override the actions of the passengers controls if desired or necessary. A communications system 410 also is provided for allowing the external controller to communicate with the interior of the sealable chamber 10, such as for touring information or training instruction. This communication system may include any form of electronic or mechanical system that can transmit sounds or electronic information. For example, the communications system may include a computer input device, such as a keyboard, and a display or the communications system may include an intercom. External controls 420 are provided for operation of the watercraft, including controls for direction of travel, velocity, depth and/or braking. The external operator or occupant may be connected to an emergency safety switch 460, so that if the operator or occupant leaves the external control station, whether voluntarily or involuntarily, the switch 460 operates to stop the craft or return it to the surface.

Figure 17:
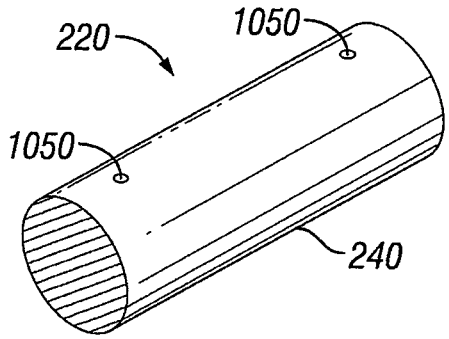
FIG. 17 is a side perspective view of an embodiment of an uninflated buoyancy chamber in accordance with the present disclosure.
Figure 18:
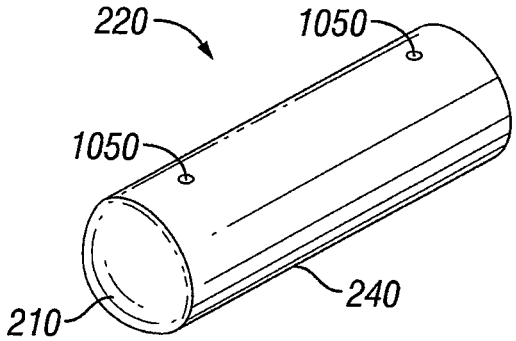
FIG. 18 is a side perspective view of an embodiment of an inflated buoyancy chamber in accordance with the present disclosure.
Figure 19:
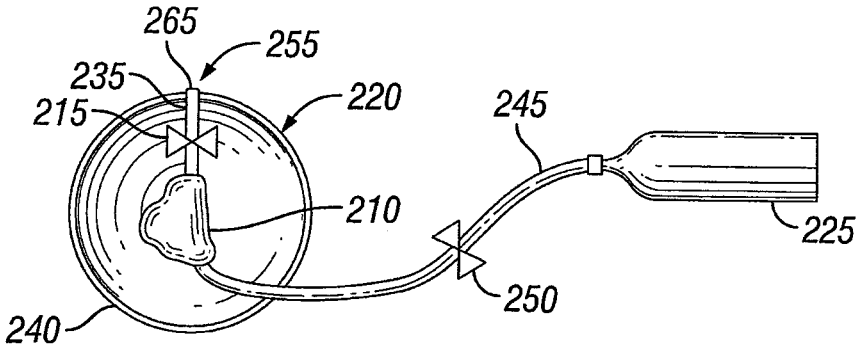
FIG. 19 is a front view of an embodiment of an uninflated buoyancy chamber with attached inflation system in accordance with the present disclosure.

Additional buoyancy of the underwater craft also can be provided using a surface-buoyancy supplementing system, which will be described with reference to FIGS. 17-19. In the surface buoyancy supplementing system, buoyancy chambers 220 are used. Either hard or soft buoyancy chambers may be used. Hard buoyancy chambers provide buoyant force when flushed of water, leaving an evacuated chamber, e.g., filled with unpressurized air, but having sufficient structural rigidity to provide buoyancy. When less buoyancy is desired, the hard chambers are allowed to fill with water, creating a generally neutral buoyancy. The chambers 220 may be used to provide buoyancy, for example, when the underwater craft is on the surface of the water. For example, when submerged, water is allowed to flow into hard chambers 220, creating a neutral buoyancy.

In exemplary embodiments, supplemental buoyancy chambers 220 are "soft" chambers. A resilient inflation bladder 210 is provided within a mounting structure 240. A cylindrical mounting structure 240 is illustrated, but any suitable shape may be used so long as the inflation bladder 210 can be mounted to the support structure 510 of the underwater craft. Any water tight material can be used, such as a rubber or plastic or other polymer. To provide buoyancy, the soft chambers are filled with a fluid having a lower density than water. Any gas or fluid may be used, and in exemplary embodiments the fluid is air such as can be provided by standard scuba air tanks 225.

To decrease buoyancy, the air is evacuated from bladder 210. Any exhaust apparatus 230 for evacuating the bladder 210 may be used, including an active system such as a pump or a passive system such as a valve 215. For example, a passive system is used and when opened, ambient pressure on the external surfaces of the bladder 210 operate to collapse the bladder 210, forcing out any inflation fluid contained therein. To prevent water intrusion into the bladder 210, a one-way valve 215 may be used in the exhaust system 255. The exhaust system may have single or multiple ports 265. The ports 265 are connected with the interior of the bladder 210 using piping 235. The piping 235 may connect to any location on the bladder 210, including for example, the bottom, side, front, rear or top. Likewise, the ports 265 can be at any location on the mounting structure 240, and in exemplary embodiments the ports 265 be generally situated above the bladder 210, promoting passive evacuation, i.e. using water pressure alone to force the inflation fluid out of the bladder 210.

In operation, when the bladder 210 is fully inflated it occupies a volume providing buoyant force. The bladder 210 may assume a streamlined shape when inflated so as to reduce drag, but any shape may be used. When the bladder 210 is deflated, it collapses under the force of ambient water pressure. In exemplary embodiments one or more standard scuba air tanks 225 and associated pressure regulators are used to provide a source of inflation fluid, namely pressurized air. A valve 250 is opened in order to force air into the bladder 210. The air travels through tubing 245 to the interior of the bladder 210, inflating the bladder 210 by overcoming the ambient aquatic pressure.

Thus, it is seen that sealable dome assemblies are provided. It should be understood that any of the foregoing configurations and specialized components may be interchangeably used with any of the systems of the preceding embodiments. Although illustrative embodiments of the present invention are described hereinabove, it will be evident to one skilled in the art that various changes and modifications may be made therein without departing from the invention. It is intended in the appended claims to cover all such changes and modifications that fall within the true spirit and scope of the invention.

The invention claimed is:

1. A dome assembly comprising:

an upper hemispherical window having a first end surface, an upper ring assembly being sealingly connected to the upper hemispherical window at or near the first end surface;

a lower hemispherical window having an outer surface, and a second end surface, a lower ring assembly being sealingly connected to the lower hemispherical window at or near the second end surface;

one or more spider retainer assemblies comprising:

a spider ring assembly including a thrust ring positioned adjacent the outer surface of the lower hemisphere window at an end opposite the seconde end surface;

one or more saddle arms having a first end and a second end, each saddle arm being fixedly attached to the spider ring assembly at its first end and fixedly attached to the lower ring assembly at its second end, the one or more saddle arms retaining the spider ring assembly and the lower ring assembly in substantially fixed relation to one another.

2. The dome assembly of claim 1 wherein the one or more saddle arms comprise:

a first saddle arm extending adjacent a first side of one or more of the upper hemispherical window and the lower hemispherical window;

a second saddle arm extending adjacent a second side of one or more of the upper hemispherical window and the lower hemispherical window, the second side being approximately 180° from the first side; and a third saddle arm extending adjacent a third side of one or more of the upper hemispherical window and the lower hemispherical window, the third side being about halfway between the first side and the second side.

3. The dome assembly of claim 1 wherein the lower ring assembly comprises a lower forging equatorial ring and a lower equatorial retainer ring fastened thereto.

4. The dome assembly of claim 1 wherein the spider ring assembly comprises:

a substantially rigid thrust ring;

a spider retainer ring; and a gasket;

wherein the spider retainer ring and the gasket fasten the thrust ring to one or more of the upper hemispherical window and the lower hemispherical window.

5. The dome assembly of claim 3, the lower equatorial ring having a base seat, the dome assembly further comprising:

a gasket attached to the lower equatorial ring and disposed between the lower equatorial ring and the second end surface of the lower hemispherical window; and at least one O-ring seal disposed between the base seat and the lower hemispherical window;

wherein the at least one O-ring seal provides a sealing connection between the lower quatorial ring and the lower hemispherical window.

6. The dome assembly of claim 5 wherein the gasket is made of a substantially soft material.

7. The dome assembly of claim 5 wherein the gasket is made of a substantially hard material.

8. The dome assembly of claim 1 wherein the upper ring assembly comprises an upper ring and an upper retainer ring fastened to the upper ring, further comprising:

a flange at the first end surface of the upper hemispherical window;

a substantially hard gasket attached to the upper ring and disposed between the upper ring and the first end surface of the upper hemispherical window; and a substantially soft gasket disposed between the upper retainer ring and the flange;

wherein the flange, the substantially soft gasket, the upper ring and the upper retainer ring form a sealing connection between the upper ring and the upper hemispherical window.

9. The dome assembly of claim 1 wherein the upper hemispherical window and the lower hemispherical window are different sizes.

10. An underwater craft comprising:

a support structure;

a sealable chamber defining an interior space;

a first operator station within said sealable chamber interior; and said sealable chamber comprising:

a first hemisphere having an outer surface, a first end surface, an upper ring assembly being sealingly connected to the upper hemispherical window at or near the first end surface;

a second hemisphere having an outer surface, a second end surface, a lower ring assembly being sealingly connected to the lower hemispherical window at or near the second end surface; and a retainer assembly mounting the sealable chamber to the support structure, the retainer assembly comprising:

a spider ring assembly mounted on the support structure adjacent said outer surface of one of the first hemisphere or the second hemisphere; and one or more substantially rigid saddle arms each having a first end and a second end and being fixedly attached to the spider ring assembly at its first end and fixedly attached to one of the lower ring assembly or the upper ring assembly at its second end, the one or more saddle arms retaining the spider ring assembly and respective ring assembly in substantially fixed relation to one another.

11. The underwater craft of claim 10 wherein the spider ring assembly comprises:

a substantially rigid thrust ring;

a spider retainer ring;

and a gasket;

wherein the spider retainer ring and the gasket fasten the thrust ring to one or more of the upper hemispherical window and the lower hemispherical window.

12. The underwater craft of claim 10 wherein the lower ring assembly comprises a lower equatorial ring and a lower retainer ring fastened thereto.

13. The underwater craft of claim 12 wherein the lower equatorial ring has a base seat, further comprising:

a gasket attached to the lower equatorial ring and disposed between the lower equatorial ring and the second end surface of the lower hemispherical window; and at least one O-ring seal disposed between the base seat and the lower hemispherical window;

wherein the at least one O-ring seal provides a sealing connection between the lower ring and the lower hemispherical window.

14. The underwater craft of claim 13 wherein the gasket is made of a substantially hard material.

15. The underwater craft of claim 10 wherein the one or more saddle arms comprise:

a first saddle arm extending adjacent a first side of one or more of the upper hemispherical window and the lower hemispherical window;

a second saddle arm extending adjacent a second side of one or more of the upper hemispherical window and the lower hemispherical window, the second side being approximately 180° from the first side; and a third saddle arm extending adjacent a third side of one or more of the upper hemispherical window and the lower hemispherical window, the third side being about halfway between the first side and the second side.

16. The underwater craft of claim 10 wherein the upper ring assembly comprises an upper ring and an upper retainer ring fastened to the upper ring, further comprising:

a flange at the first end surface of the upper hemispherical window;

a substantially hard gasket attached to the upper ring and disposed between the upper ring and the first end surface of the upper hemispherical window; and a substantially soft gasket disposed between the upper retainer ring and the flange;

wherein the flange, the substantially soft gasket, the upper ring and the upper retainer ring form a sealing connection between the upper ring and the upper hemispherical window.

* * * * *